US009236203B2

(12) United States Patent
Davis

(10) Patent No.: US 9,236,203 B2
(45) Date of Patent: Jan. 12, 2016

(54) PUSHBUTTON PULLSTRING ADAPTER FOR HEARING AID

(71) Applicant: Audina Hearing Instruments, Longwood, FL (US)

(72) Inventor: Glenn J. Davis, Longwood, FL (US)

(73) Assignee: Audina Hearing Instruments Inc., Longwood, FL (US)

( * ) Notice: Subject to any disclaimer, the term of this patent is extended or adjusted under 35 U.S.C. 154(b) by 203 days.

(21) Appl. No.: 13/965,785

(22) Filed: Aug. 13, 2013

(65) Prior Publication Data

US 2015/0047960 A1 Feb. 19, 2015

(51) Int. Cl.
*H01H 13/14* (2006.01)
*H04R 25/00* (2006.01)

(52) U.S. Cl.
CPC ..... *H01H 13/14* (2013.01); *H01H 2221/024* (2013.01); *H01H 2300/004* (2013.01); *H04R 25/65* (2013.01); *H04R 2225/61* (2013.01)

(58) Field of Classification Search
CPC ..... H01H 13/14; H01H 19/58
USPC ..... 200/52 R, 329–331, 337–338, 413, 418, 200/61.67, 277.1, 543; 181/129–130; 381/328–329, 322
See application file for complete search history.

(56) References Cited

U.S. PATENT DOCUMENTS 7,987,977 B2 * 8/2011 Leedom et al. ..... 206/305
2009/0129618 A1 * 5/2009 Heerlein et al. ..... 381/328

* cited by examiner

*Primary Examiner* — Edwin A. Leon
*Assistant Examiner* — Iman Malakooti
(74) *Attorney, Agent, or Firm* — Luedeka Neely Group, P.C.

(57) ABSTRACT

A pushbutton pullstring adaptor includes a pullstring and a housing enclosing a pushbutton. The pullstring includes an engagement portion and elongate string portion. The engagement portion, which is disposed within the housing, moves with respect to the housing to engage the pushbutton when a pushing force is applied and to engage the end of the housing when a pulling force is applied. One end of the string portion is securely attached to the engagement portion. The other end of the string portion passes through an aperture in the housing. The string portion moves freely through the aperture when a pushing force or pulling force is applied. When a pushing force is applied to the string portion, the engagement portion engages the pushbutton to control the hearing aid. When a pulling force is applied, the engagement portion engages the housing to remove the hearing aid from a user's ear.

7 Claims, 3 Drawing Sheets

PUSHBUTTON PULLSTRING ADAPTER FOR HEARING AID

FIELD

This invention relates to hearing aids. More particularly, this invention relates to a structure that may be used to operate a pushbutton on a hearing aid and to remove the hearing aid from the ear canal.

BACKGROUND

Electronic hearing aids are provided in various configurations, including behind the ear (BTE), in the ear (ITE), in the canal (ITC) and completely in the canal (CIC) models. Push button controls are provided on most hearing aids for controlling program selection and other functions. Due to the very small size of most modern hearing aid devices, in particular the ITC and CIC configurations, usable surface space for control components such as push buttons is at a premium. Thus, it is desirable to minimize the needed surface area for push button controls.

It is also desirable to provide control structures on hearing aid devices that are more readily accessible than standard push buttons so that users may more easily change programs and adjust other functions.

What is needed, therefore, is an improvement in hearing aid push button design to save space and make push buttons easier to operate.

SUMMARY

The above and other needs are met by an apparatus for engaging a pushbutton assembly used in controlling a hearing aid configured to fit at least partially within a user's ear. The apparatus is also referred to herein as a pushbutton pullstring adaptor. In a preferred embodiment, the pushbutton pullstring adaptor includes a housing and a pullstring assembly.

The housing has an interior portion that at least partially encloses the pushbutton assembly. The housing has a first end portion disposed opposite a second end portion. The first end portion has a first aperture that has a first aperture width. The second end portion has a second aperture that has a second aperture width.

The pullstring assembly includes an engagement portion and an elongate string portion. The engagement portion is disposed inside the housing adjacent the second end portion of the housing. The engagement portion is movable with respect to the housing and is operable to engage the pushbutton assembly when a pushing force is applied to the engagement portion. The engagement portion is also operable to engage the second end portion of the housing when a pulling force is applied to the engagement portion. The engagement portion has an engagement portion width that is larger than the second aperture width. The elongate string portion has a first string end and a second string end. The first string end is disposed within the housing and is securely attached to the engagement portion. The second string end is disposed outside the housing. The string portion has a string portion width that is less than the second aperture width so that the string portion may move through the second aperture when a pushing force or pulling force is applied to the string portion.

In this configuration, the user of the hearing aid may apply a pushing force to the string portion of the pullstring assembly to cause the engagement portion to engage the pushbutton assembly for controlling the hearing aid. The user may also apply a pulling force to the string portion of the pullstring assembly to cause the engagement portion to engage the second end portion of the housing to remove the hearing aid from the user's ear.

In some preferred embodiments, the first end portion of the housing is cylindrical and has a first inner diameter. In these embodiments, the first aperture is circular and has a first aperture diameter that is larger than the outer diameter of a cylindrical body portion of a pushbutton assembly. The first inner diameter of the first end portion is sized to receive the cylindrical body portion of the pushbutton assembly in a press fit configuration.

In some preferred embodiments, the second end portion of the housing is also cylindrical and has a second inner diameter that is larger than the outer diameter of the cylindrical button portion of the pushbutton assembly. With this configuration, the button portion may move freely within the second end portion of the housing when the engagement portion of the pullstring assembly applies a pushing force to the button portion.

BRIEF DESCRIPTION OF THE DRAWINGS

Other embodiments of the invention will become apparent by reference to the detailed description in conjunction with the figures, wherein elements are not to scale so as to more clearly show the details, wherein like reference numbers indicate like elements throughout the several views, and wherein.

DETAILED DESCRIPTION

A preferred embodiment of a pushbutton pullstring adapter 10 is depicted in FIGS. 1, 2 and 4-7. The adapter 10 includes a housing 12 that is preferably an integral structure formed of plastic, such as by injection molding. The housing includes a first end portion 12*a* and a second end portion 12*b*. In one embodiment depicted in cross-section in FIG. 4, the first end portion 12*a* is cylindrical and has an inside diameter D1 of approximately 0.076 inch and length L1 of approximately 0.060 inch, and the second end portion 12*b* is also cylindrical and has an inside diameter D2 of approximately 0.080 inch and length L2 of approximately 0.080 inch. One skilled in the art will appreciate that other dimensions may be used, and the invention is not limited to any particular set of dimensions.

Figure 1:
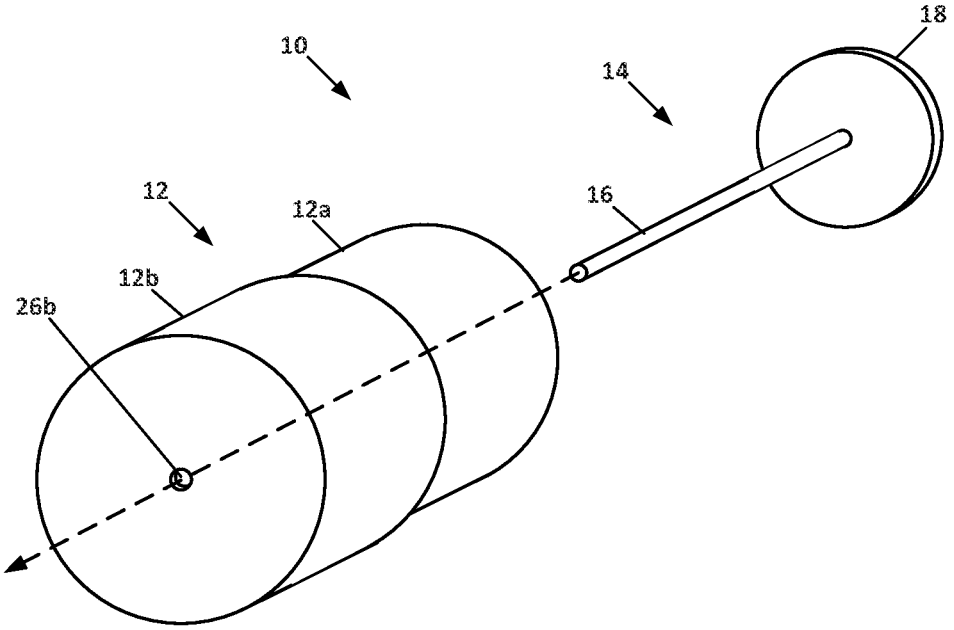
FIG. 1 depicts a front perspective view of a pushbutton pullstring adapter assembly according to an embodiment of the invention.
Figure 2:
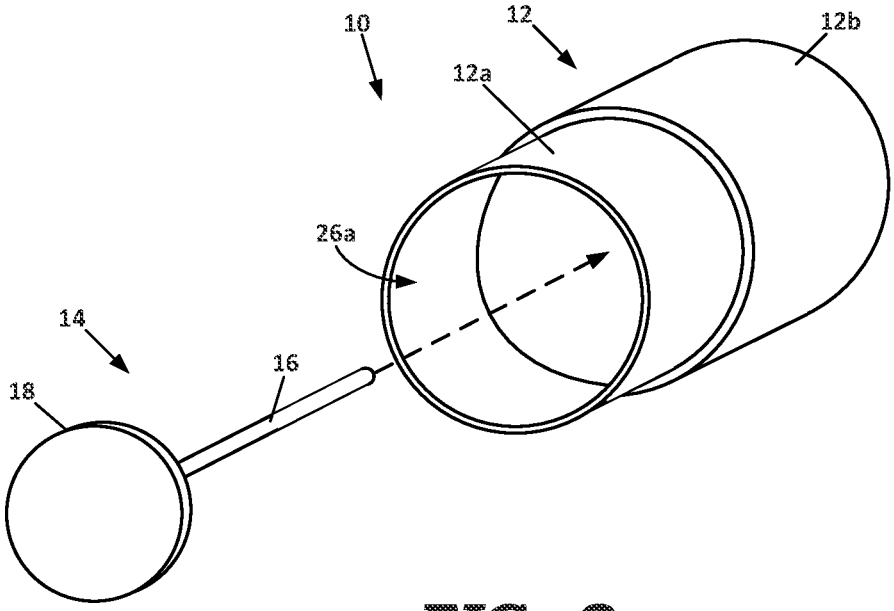
FIG. 2 depicts a rear perspective view of a pushbutton pullstring adapter assembly according to an embodiment of the invention.
Figure 3:
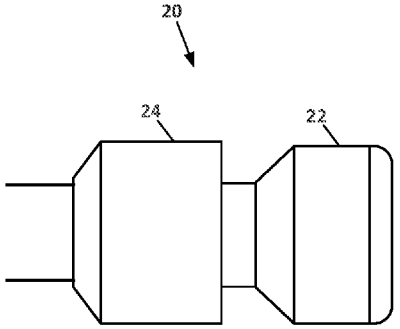
FIG. 3 depicts a pushbutton for a hearing aid.

With the dimensions described above, the open interior of the housing 12 is configured to receive a standard pushbutton assembly 20, such as depicted in FIG. 3. The pushbutton assembly 20, such as model PBS100 manufactured by Sonion of Denmark, includes a button portion 22 and a body portion 24, both of which are preferably cylindrical. When the body portion 24 is held stationary, the spring-loaded button portion 22 is operable to move in and out relative to the body portion 24 when the button portion 22 is pressed and released.

The housing 12 includes a large first aperture 26*a* in the first end portion 12*a* that is open to receive the pushbutton 20. In a preferred embodiment, the diameter of the first aperture 26*a* is approximately 0.076 inch. A smaller second aperture 32*b* is centrally located in the second end portion 12*b*. In a preferred embodiment, the diameter of the second aperture 26*b* is approximately 0.0028 inch.

The adapter 10 also includes a pullstring assembly 14 comprising a string portion 16 and an engagement portion 18. In a preferred embodiment, the pullstring assembly 14 is an integral structure formed of plastic, such as by injection molding. The engagement portion 18 is preferably cylindrical, having a diameter of approximately 0.070 inch and thickness of approximately 0.020 inch. The string portion 16 comprises a relatively stiff yet flexible rod having a diameter of slightly less than the diameter of the aperture 26.

Figure 4:
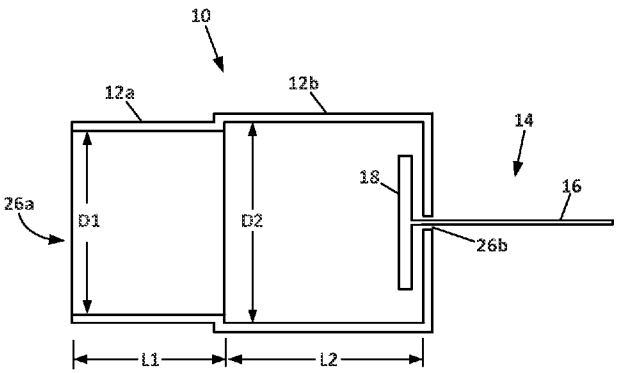
FIG. 4 depicts a cross-sectional view of a pushbutton pullstring adapter assembly according to an embodiment of the invention.

To assemble the adapter 10, the string portion 16 of the pullstring assembly 14 is passed through the first aperture 26*a* into the first end portion 12*a* of the housing 12, into the second end portion 12*b*, through the second aperture 26*b* in the second end portion 12*b*, and pulled through to a position at which the engagement portion 18 is disposed within the second end portion 12*b* of the housing 12. After assembly, the adapter 10 is preferably configured as shown in FIG. 4.

The pushbutton assembly 20 is assembled with the adaptor 10 by inserting the button portion 22 into the first aperture 26*a* of the housing 12 and pushing the body portion 24 forward to engage the inside surface of the first end portion 12*a* of the housing 12. In a preferred embodiment, the outer diameter of the body portion 24 of the pushbutton assembly 20 is only slightly smaller than the inner diameter of the first end portion 12*a* of the housing so that the body portion 24 engages the first end portion 12*a* in a press-fit configuration. A small amount of adhesive, such as epoxy, may be applied between the body portion 24 of the pushbutton assembly 20 and the inner surface of the first end portion 12*a* of the housing 12 to more securely attach the pushbutton assembly 20 to the housing 12.

Figure 5:
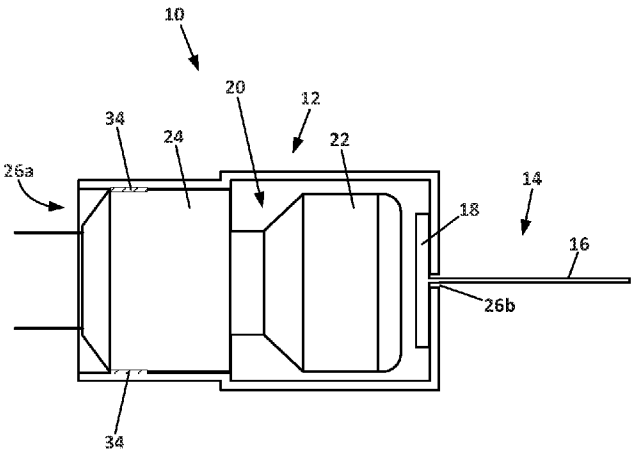
FIG. 5 depicts a cross-sectional view of a pushbutton installed in a pushbutton pullstring adapter assembly with the pullstring in a pulling position according to an embodiment of the invention.
Figure 6:
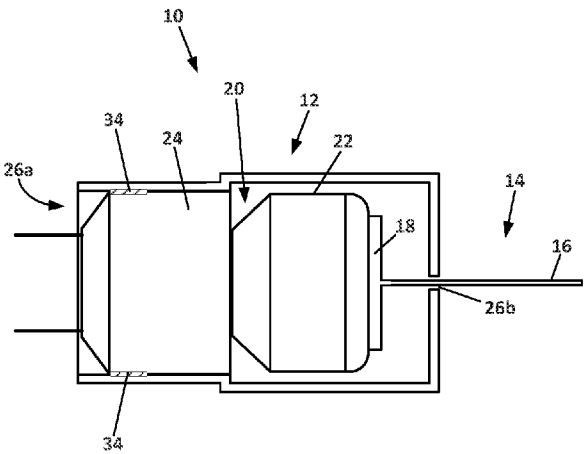
FIG. 6 depicts a cross-sectional view of a pushbutton installed in a pushbutton pullstring adapter assembly with the pullstring in a pushing position according to an embodiment of the invention.

FIGS. 5 and 6 depict the adaptor 10 with the pushbutton assembly 20 fastened thereto. In FIG. 5, the pullstring assembly 14 is in a neutral position wherein the engagement portion 18 of the pullstring assembly 14 is disengaged from the button portion 22 of the pushbutton assembly 20. In FIG. 6, the pullstring assembly 14 is in an activated position wherein the engagement portion 18 of the pullstring assembly 14 is pressed against the button portion 22 of the pushbutton assembly 20 such that the button portion 22 has moved toward the body portion 24 to activate a switch mechanism within the pushbutton assembly 20. It will be appreciated that the stiffness of the string portion 16 should be sufficient to transfer a pushing force from the engagement portion 18 to the button portion 22 when a user pushes the string portion 16 to activate the pushbutton assembly 20.

In a preferred embodiment, the engagement portion 18 of the pullstring assembly 14 is disk shaped, with the flat sides of the disk engaging the button portion 22 to activate the pushbutton assembly 20 when the string portion 16 is pushed, and engaging the inner surface of the second end portion 12*b* of the housing 12 when the string portion 16 is pulled. However, it should be appreciated that the engagement portion 18 may be in another shape, such as spherical or cubical. Thus, the invention is not limited to any particular shape of the engagement portion 18.

In some embodiments, it may be desirable for the engagement portion 18 to substantially fill the space between the surface of the button portion 22 and the inner walls of the second end 12*b* of the housing 12 when the engagement portion 18 is in the position shown in FIG. 5. This would prevent the pullstring assembly 14 from being loose within the housing 12 and rattling against the inner surface of the housing 12 as the user's head moves around.

Figure 7:
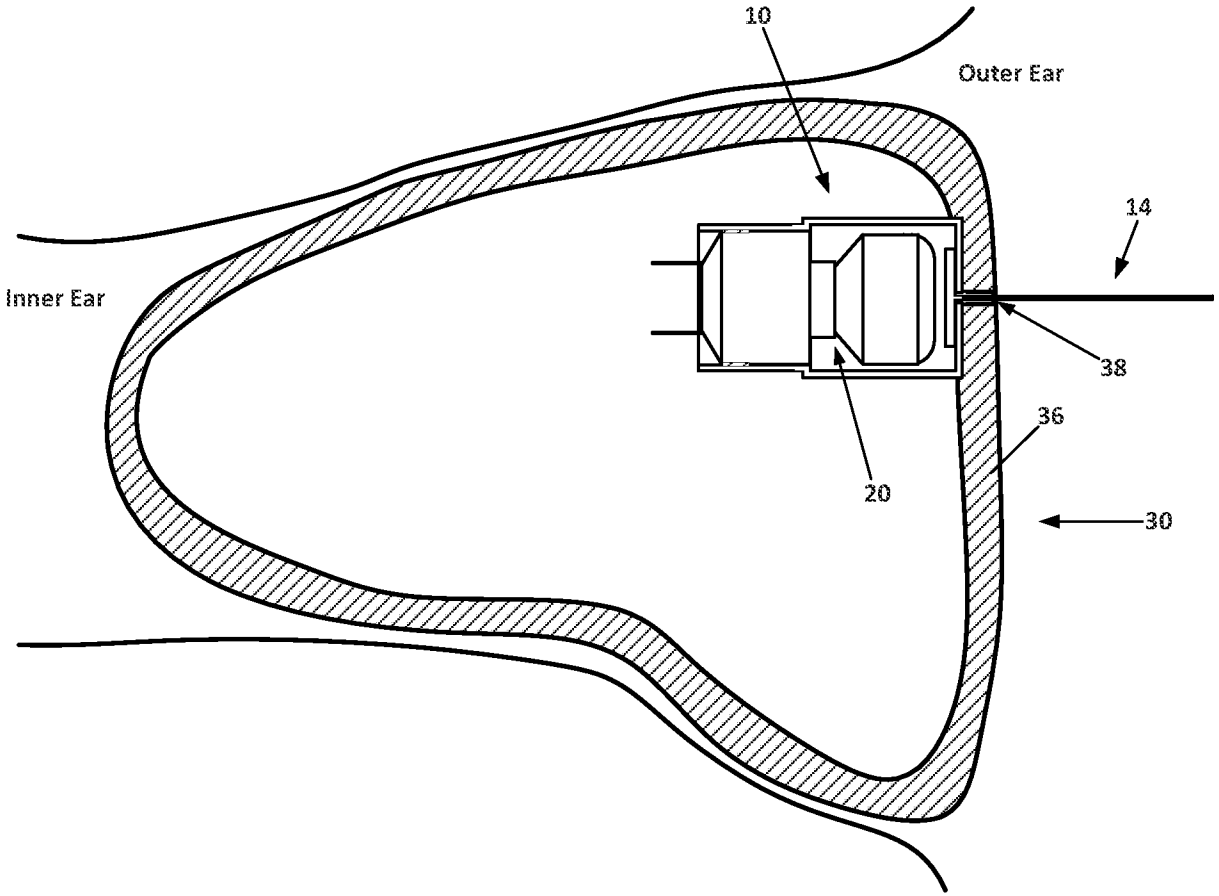
FIG. 7 depicts a cross-sectional view of a pushbutton pullstring adapter assembly with a pushbutton installed in an ITE hearing aid according to an embodiment of the invention.

FIG. 7 depicts an ITE hearing aid 30 inserted into an ear of a user. The hearing aid 30 includes a housing 36 into which an embodiment of the pushbutton pullstring adaptor 10 is shown installed. An aperture 38 is provided in the housing 36 through which the string portion 16 of the pullstring assembly 14 passes. The user may remove the hearing aid 30 from the ear by pulling on the string portion 16. As discussed above, the user may activate the pushbutton assembly 20 by pushing on the string portion 16. Other components of the hearing aid 30 are not depicted so as to simplify the drawing.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An apparatus for engaging a pushbutton assembly used in controlling a hearing aid configured to fit at least partially within a user's ear, the apparatus comprising:

a pushbutton assembly;

a housing for at least partially enclosing the pushbutton assembly within an interior portion of the housing, the housing having a first end portion disposed opposite a second end portion, the first end portion having a first aperture with a first aperture width sized to receive the pushbutton assembly, the second end portion having a second aperture with a second aperture width; and a pullstring assembly comprising:

an engagement portion disposed within the second end portion of the housing, the engagement portion being movable with respect to the housing and operable to engage the pushbutton assembly when a pushing force is applied to the engagement portion, the engagement portion operable to engage the second end portion of the housing when a pulling force is applied to the engagement portion, the engagement portion having an engagement portion width that is larger than the second aperture width; and an elongate string portion having a first string end and a second string end, the first string end disposed within the housing and securely attached to the engagement portion, the second string end disposed outside the housing, the string portion having a string portion width that is less than the second aperture width, so that the string portion may move through the second aperture when a pushing force or pulling force is applied to the string portion, whereby the user of the hearing aid may apply a pushing force to the string portion of the pullstring assembly to cause the engagement portion to engage the pushbutton assembly for controlling the hearing aid, and whereby the user of the hearing aid may apply a pulling force to the string portion of the pullstring assembly to cause the engagement portion to engage the second end portion of the housing to remove the hearing aid from the user's ear.

2. The apparatus of claim 1 wherein at least the first end portion of the housing is cylindrical and has a first inner diameter, the first aperture is circular, the first aperture width is a first aperture diameter that is larger than an outer diameter of a cylindrical body portion of a pushbutton assembly, and the first inner diameter of the first end portion of the housing is sized to receive the cylindrical body portion of the pushbutton assembly in a press fit configuration.

3. The apparatus of claim 2 wherein the second end portion of the housing is cylindrical and has a second inner diameter that is larger than an outer diameter of a cylindrical button portion of the pushbutton assembly, such that the button portion may move freely within the second end portion of the housing when the engagement portion of the pullstring assembly applies a pushing force to the button portion.

4. The apparatus of claim 1 wherein the engagement portion comprises a cylindrical plate, and the engagement portion width is a diameter of the cylindrical plate which is greater than the second aperture width.

5. The apparatus of claim 1 wherein the elongate string portion is cylindrical and the string portion width is a string portion diameter that is less than the second aperture width.

6. The apparatus of claim 1 wherein the second aperture is circular and the second aperture width is a second aperture diameter.

7. An apparatus for engaging a pushbutton assembly used in controlling a hearing aid configured to fit at least partially within a user's ear, the apparatus comprising:

a pushbutton assembly;

a housing for at least partially enclosing the pushbutton assembly within an interior portion of the housing, the housing having:

a first cylindrical end portion having a first inner diameter sized to receive a cylindrical body portion of the pushbutton assembly in a press fit configuration; and a second cylindrical end portion having a second inner diameter that is larger than an outer diameter of a cylindrical button portion of the pushbutton assembly, such that the button portion may move freely within the second end portion of the housing when a pushing force is applied to the button portion, the second cylindrical end portion having a second circular aperture with a second aperture diameter; and a pullstring assembly comprising:

an engagement portion disposed within the second cylindrical end portion of the housing, the engagement portion being movable with respect to the housing and operable to engage the pushbutton assembly when a pushing force is applied to the engagement portion, and operable to engage the second end portion of the housing when a pulling force is applied to the engagement portion, the engagement portion having an engagement portion diameter that is larger than the second aperture diameter; and an elongate string portion having:

a first string end disposed within the housing and securely attached to the engagement portion; and a second string end disposed outside the housing, wherein the string portion has a string portion diameter that is less than the second aperture diameter, so that the string portion may move through the second aperture when a pushing force or pulling force is applied to the string portion, whereby the user of the hearing aid may apply a pushing force to the string portion of the pullstring assembly to cause the engagement portion to engage the pushbutton assembly for controlling the hearing aid, and whereby the user of the hearing aid may apply a pulling force to the string portion of the pullstring assembly to cause the engagement portion to engage the second end portion of the housing to remove the hearing aid from the user's ear.

* * * * *